US009330827B2

(12) United States Patent
Gardner et al.

(10) Patent No.: US 9,330,827 B2
(45) Date of Patent: May 3, 2016

(54) METHOD OF MANUFACTURING INDUCTORS FOR INTEGRATED CIRCUIT PACKAGES

(75) Inventors: Donald Gardner, Mountain View, CA (US); Gerhard Schrom, Hillsboro, OR (US); Fabrice Paillet, Hillsboro, OR (US); Shamala Chickamenahalli, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 1124 days.

(21) Appl. No.: 13/026,470

(22) Filed: Feb. 14, 2011

(65) Prior Publication Data

US 2011/0131797 A1 Jun. 9, 2011

Related U.S. Application Data

(62) Division of application No. 12/217,293, filed on Jul. 2, 2008, now Pat. No. 7,911,313.

(51) Int. Cl.

| | |
|---|---|
| ***H01F 17/00*** | (2006.01) |
| ***H01F 41/04*** | (2006.01) |
| *H01F 17/02* | (2006.01) |
| *H01F 27/28* | (2006.01) |

(52) U.S. Cl.

CPC ..... *H01F 17/0033* (2013.01); *H01F 17/0006* (2013.01); *H01F 41/041* (2013.01); *H01F 41/046* (2013.01); *H01F 17/02* (2013.01); *H01F 27/2804* (2013.01); *H01F 2017/002* (2013.01); *H01F 2017/0053* (2013.01); *H01F 2017/0066* (2013.01); *Y10T 29/4902* (2015.01); *Y10T 29/49073* (2015.01); *Y10T 29/49126* (2015.01); *Y10T 29/49147* (2015.01)

(58) Field of Classification Search

CPC . H01F 41/046; H01F 41/041; H01F 17/0033; H01F 27/2804; H01F 2017/002; H01F 2017/0053; H01F 2017/0066; H01F 17/0006; H01F 2017/02; Y10T 29/4902; Y10T 29/49073; Y10T 29/49126; Y10T 29/49147

USPC ..... 29/602.1, 606, 830, 842; 336/200, 223, 336/232, 234; 438/381

See application file for complete search history.

(56) References Cited

U.S. PATENT DOCUMENTS

| | | | | | |
|---|---|---|---|---|---|
| 4,873,757 | A * | 10/1989 | Williams | ..... | 29/602.1 |
| 5,801,521 | A * | 9/1998 | Mizoguchi et al. | ..... | 29/602.1 X |
| 6,653,196 | B2 * | 11/2003 | Ahn et al. | ..... | 438/381 |

FOREIGN PATENT DOCUMENTS

| | | | | | |
|---|---|---|---|---|---|
| JP | 58089819 | A * | 5/1983 | ..... | 29/602.1 X |
| JP | 04312902 | A * | 11/1992 | ..... | 29/602.1 X |

* cited by examiner

*Primary Examiner* — A. Dexter Tugbang
(74) *Attorney, Agent, or Firm* — Trop Pruner & Hu, P.C.

(57) ABSTRACT

A process of making inductors for integrated circuit packages may involve forming an inductor upon a magnetic film on a package substrate. Conductors coupled either to a die or a voltage converter extend perpendicularly through the film to conductive plates, defining current paths through and across the film.

8 Claims, 2 Drawing Sheets

METHOD OF MANUFACTURING INDUCTORS FOR INTEGRATED CIRCUIT PACKAGES

CROSS-REFERENCE TO RELATED APPLICATIONS

This application is a divisional of U.S. patent application Ser. No. 12/217,293, filed on Jul. 2, 2008 now U.S. Pat. No. 7,911,313.

BACKGROUND

This relates generally to integrated circuits, packages for integrated circuits, and inductors for use with integrated circuits.

Inductors and transformers may be used in microelectronic circuits as part of voltage converters and for electromagnetic interference noise reduction. Conventionally, transformers have cores and wire windings wrapped around those cores.

In order to form an inductor for use in a voltage regulator that supplies current to an integrated circuit, it would be desirable to have a way to make such transformers using conventional integrated circuit techniques. As a result, such devices could be made inexpensively, for example, while also making integrated electronic components.

DETAILED DESCRIPTION

Figure 1:
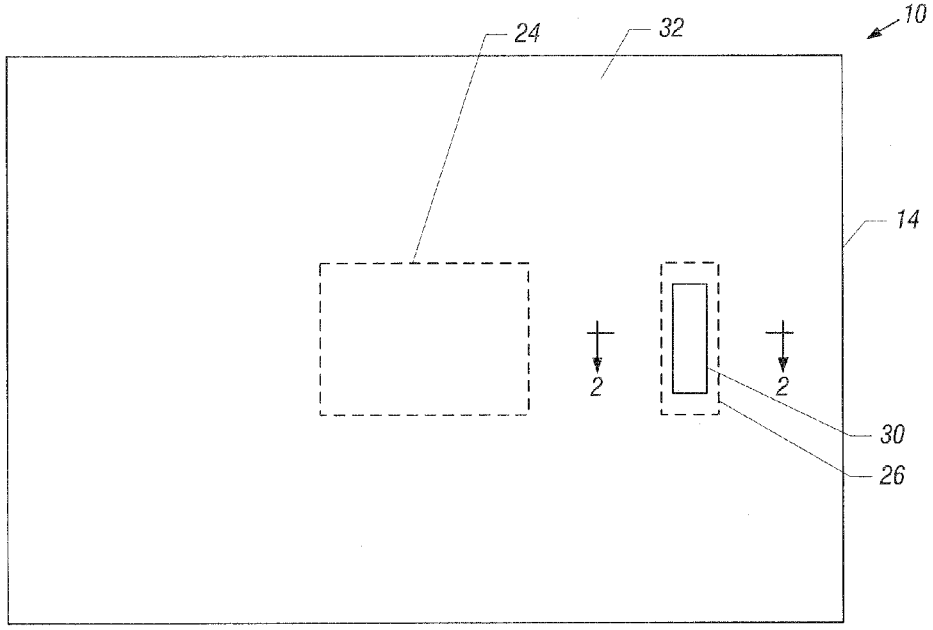
FIG. 1 is an enlarged, bottom view of a substrate in accordance with one embodiment of the present invention.

Referring to FIG. 1, an integrated circuit package 10 may include a substrate 14. The substrate 14 is generally an insulating material with conductive paths for conveying signals between different components mounted on the substrate 14. For example, the substrate 14 may be a printed circuit board.

In accordance with some embodiments, the substrate 14 is enclosed to form a circuit package that provides for connections to various internal, packaged components. The package encloses the substrate 10 and the substrate 10 mounts an integrated circuit die 24 on the opposite substrate side to the side depicted in FIG. 1.

On the substrate 14 side depicted in FIG. 1, an integrated inductor 30 may be mounted. The integrated inductor 30, in one embodiment, may actually be part of a transformer. The integrated inductor 30 extends through the substrate 14, in one embodiment, to a voltage converter 26 on the opposite side of the board 14. Conventionally, the voltage converter may be coupled to a power supply (not shown).

Thus, the inductor 30 may be part of a transformer utilized in connection with the voltage converter 26 to supply power to the die 24, which may be a controller or processor, as examples. In some embodiments, the inductor 30 may be effectively mounted directly on the substrate 14 of an integrated package, enabling a smaller size and reducing the distance between the voltage converter 26, the integrated inductor 30, and the die 24.

Figure 2:
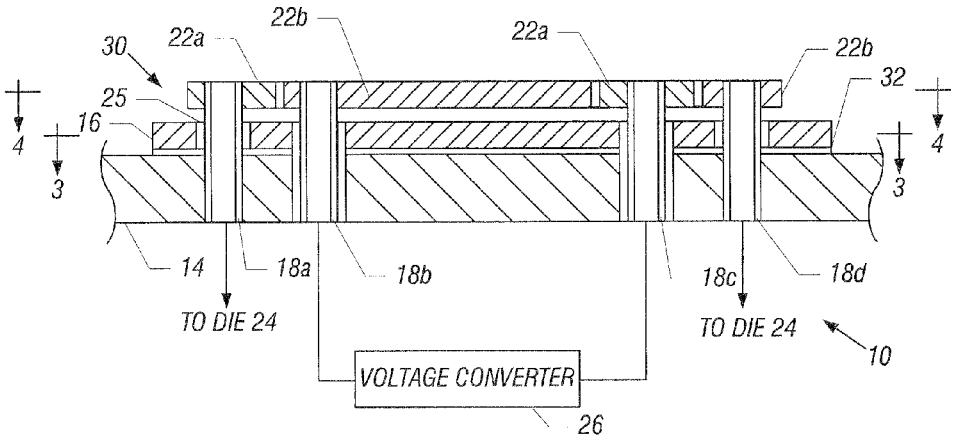
FIG. 2 is a partial, enlarged, cross-sectional view taken generally along the line 2-2 in FIG. 1.

Referring to FIG. 2, the integrated inductor 30 may include a planar film 16 of magnetic material. In some embodiments, the film 16 may be made up of a number of layers of magnetic material. The use of a number of laminations or layers, instead of one solid material, may be useful in reducing eddy currents in some embodiments. Suitable magnetic materials for film 16 include CoZrTa, CoFeHfO, CoPRe, CoPFeRe, or NiFe.

A plurality of conductors 18*a*-18*d* extend vertically and perpendicularly through the horizontal magnetic film 16. The conductors 18 may be tubular and, in some embodiments, for example, may be formed as plated through holes. The conductors 18 may, in some embodiments, be hollow copper cylinders with an insulating material in the center. In some cases, the ends of the conductors 18 may be closed by a conductive end cap that may be formed by suitable plating operations. As one example, the tubular conductors 18 may be formed of copper.

The conductors 18*a* and 18*d*, in the form of vertically extending vias, do not contact the magnetic film 16, but, instead, a gap 25 is formed between the conductors 18*a* and 18*d* and the proximate magnetic film 16. However, the conductors 18*a* and 18*d* make electrical contact to the substrate 14 and to the horizontal conductors 22*a* and 22*b*. In some embodiments, the conductors 22 may be planar and parallel to the film 16.

In contrast, the conductors 18*b* and 18*c* make electrical and physical contact only with the voltage converter 26 and the horizontal conductors 22*a* and 22*b*.

Thus, current can flow through the voltage converter 26 and into a horizontal conductor 22*a* or 22*b*, as the case may be, from conductors 18*b* and 18*c*. The conductors 18*a* and 18*d* may be coupled to the die 24 in one embodiment. Thus, the inductor structure is between the voltage converter 26 and the die 24.

A polyimide (not shown) may be used, in one embodiment, between the magnetic film 16 and the horizontal conductors 22*a* and 22*b*. An insulator 32 may be provided between the substrate 14 and the magnetic material 16, in one embodiment.

Figure 3:
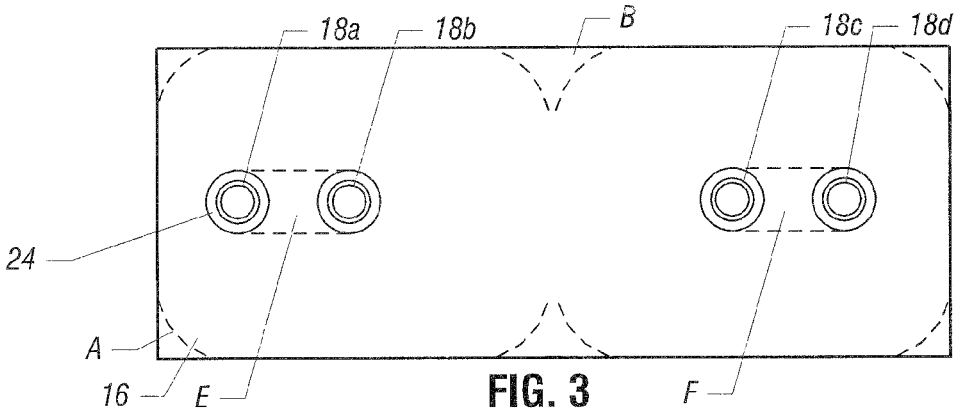
FIG. 3 is a partial, cross-sectional view taken generally along the line 3-3 in FIG. 2.

Referring to FIG. 3, the conductors 18*a* and 18*b* do not contact the magnetic film 16, but pass through the magnetic material without touching or making electrical contact. As a result of current flowing through the conductors 18*a* and 18*c* by way of the horizontal plate 22*a* and current flowing through the conductors 18*b* and 18*d* by way of the horizontal plate 22*b*, magnetic fields revolve around the conductors 18.

The field strength of the magnetic field is relatively low in the regions at the corners A and intermediately, as indicated at B. Thus, in some embodiments, the magnetic material may be effectively eliminated from these areas, reducing the eddy currents.

Further, as indicated in the regions E and F, the magnetic material may be effectively eliminated between adjacent conductors, such as the conductors 18*a* and 18*b* and 18*c* and 18*d*, in some embodiments. This will help decrease the eddy currents in some embodiments.

Figure 4:
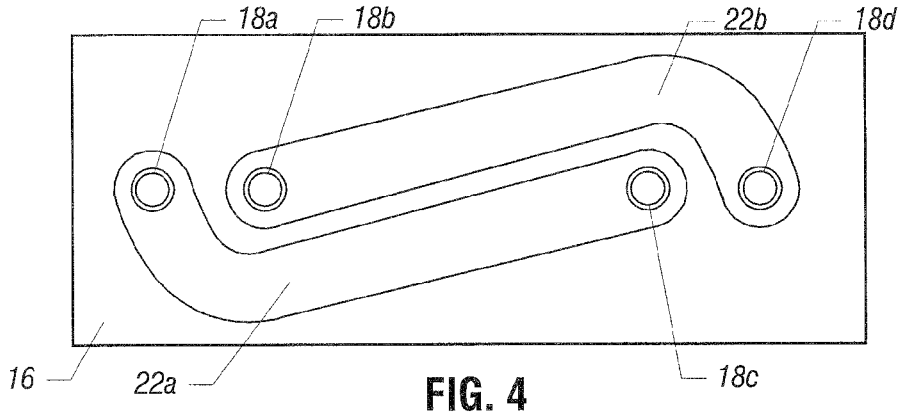
FIG. 4 is a cross-sectional view taken generally along the line 4-4 in FIG. 2.

Referring to FIG. 4, the conductors 18*a*-18*d* are effectively aligned or collinear, in one embodiment. Thus, current passing through a horizontal plate 22*a*, via conductors 18*a* and 18*b*, bypasses the other conductors and vice versa. The plates 22*a* and 22*b* may be coplanar in one embodiment. In some cases, the transformer may be made up of a large number of such horizontal plates 22*a* and 22*b*, coupled through a larger number of conductors 18.

In accordance with one embodiment of the present invention, the magnetic film 16 may be formed by first forming a seed layer 28 on the insulator 32. Then, the first layer 16*a* of magnetic material may be deposited while exposed to a magnetic field which creates a hard axis, indicated at D. Then, a layer of insulator 20 may be deposited. Thereafter, another layer 16*b* of magnetic material may be deposited while being exposed to an orthogonal oriented magnetic field to create a hard axis C perpendicular to the axis D. This may be followed by any number of additional layers of the type, indicated at 16*a*, 20, and 16*b*, to build up a desired thickness.

In one embodiment, if the XY plane is the plane of the substrate 14, alternately depositing the magnetic material laminations with orthogonal hard axes of magnetization in the direction of the X axis, then the Y axis creates a microstructure with two hard axes in the plane of the substrate.

Advantageously, the directions of the major axes D and C alternate from magnetic lamination to the next. Thus, in combination, the overall film 16 has good magnetic properties in both the C and D directions.

Figure 5:
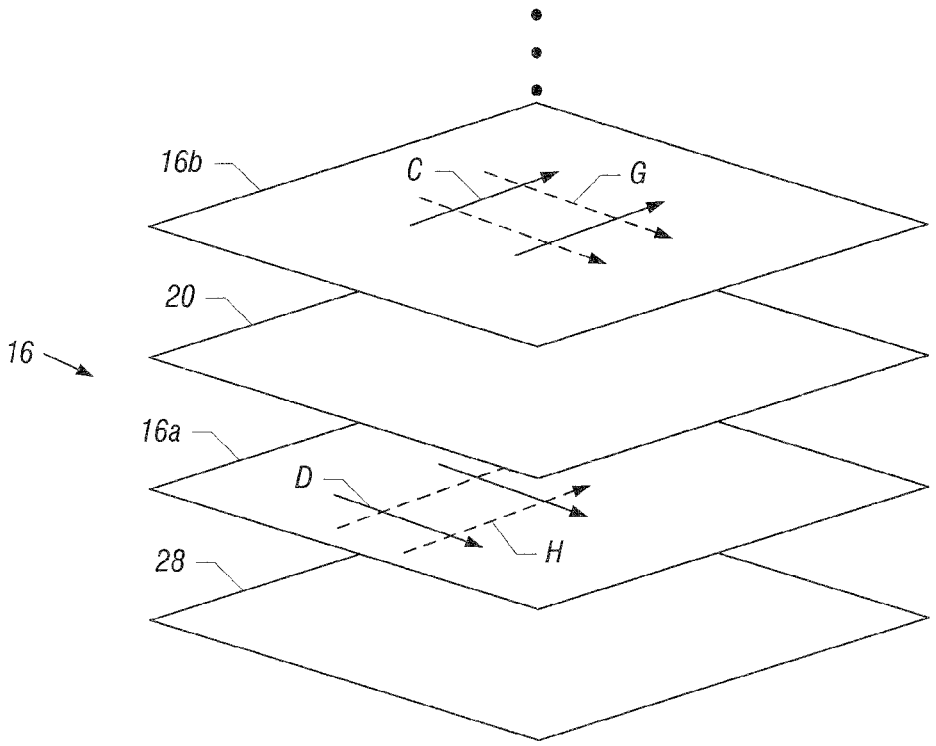
FIG. 5 is a perspective, exploded view of one embodiment of the magnetic film used in the embodiment shown in FIG. 2.

Alternatively, in some embodiments, the magnetic material may be formed and annealed with a perpendicular magnetic field such that both hard axes are in each plane. Thus, referring to FIG. 5, this would result in the hard axes of magnetization H being provided in addition to the axes D in the layer 16*a* and the hard axes of magnetization G, in addition to the axes C, in the layer 16*b*.

A variety of adhesion layers may be used if necessary. For example, thin titanium or tantalum adhesion layers may be utilized with CoZrTa magnetic material. Electroplating may be used to form the layers in some embodiments. However, in other embodiments, electroless plating techniques may be utilized.

In one embodiment, twenty nanometers of titanium layer deposition may be followed by an 0.1 to 0.2 micron thick copper seed layer or an 0.3 micron thick cobalt seed layer, followed by filling of the conductors 18 with an insulator or other material, including conductive materials. In some embodiments, it is advantageous to use a tubular conductor since the conductivity is largely a function of the outside diameter.

Suitable materials for the insulator 20 include silicon dioxide, aluminum oxide, cobalt oxide, polyimide, silicon nitride, or any other insulator. Advantageously, the insulator 20 is made as thin as possible and, advantageously, may be less than the thickness of any layer of the magnetic film 16.

The layers 16*a* and 16*b* may be on the order of one-half micron in thickness in one embodiment. Four to ten lamination layers may be formed to create the desired thickness. For example, films 16 of from two to twenty microns thick may use from four to twenty lamination layers, as examples.

In some embodiments, shape anisotropy may be used to provide a preferred direction in each lamination, thereby making the overall combined film 16 thick enough to have good magnetic properties in the C and D directions.

In some embodiments, the film 16 may be shaped using conventional photolithography techniques. Generally, the sizes of the components may be relatively small and, in some embodiments, voltages of one to two volts may be utilized.

In some embodiments, it is advantageous that the magnetic film 16 is formed in a plane, while the current flow through the conductors 18 is perpendicular to the plane of the magnetic film 16. This may reduce eddy currents in some embodiments. In some embodiments, it is desirable to have only one composite magnetic material film 16 to avoid using magnetic vias that can exacerbate eddy currents. In some embodiments, a quality factor at 30 MHz of twenty to fifty is possible using four to eight laminations, respectively.

By eliminating magnetic material from regions, such as the regions A and B of low magnetic field, eddy currents may be reduced in some embodiments. Using a magnetic film 16 that is thick enough to reduce shape anisotropy (i.e. one greater than 1.5 microns) allows for an easy axis of magnetization in the vertical direction.

Inductors and magnetic materials may, in accordance with embodiments of the present invention, be utilized for radio frequency and wireless circuits, as well as for voltage converters and for electromagnetic interference noise reduction. Integrated on die DC-DC converters control the power consumption in multi-core processor applications and are important to controlling the power delivery in mobile and ultra-mobile central processing units. Microgranular control of individual cores can be achieved to save on-power by reducing the power to individual cores as needed. An integrated DC-DC converter at high power levels of 100 watts or more can be used to supply power to a processor, graphic chips, chipsets, or other circuits.

References throughout this specification to "one embodiment" or "an embodiment" mean that a particular feature, structure, or characteristic described in connection with the embodiment is included in at least one implementation encompassed within the present invention. Thus, appearances of the phrase "one embodiment" or "in an embodiment" are not necessarily referring to the same embodiment. Furthermore, the particular features, structures, or characteristics may be instituted in other suitable forms other than the particular embodiment illustrated and all such forms may be encompassed within the claims of the present application.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

forming a planar film of magnetic material on a package substrate including a magnetic layer and insulating layers sandwiching said magnetic layer and by forming two perpendicular hard axes in said magnetic layer sandwiched between insulating layers abutting said magnetic layer; and forming conductors extending through said film perpendicularly to the plane of said film.

2. The method of claim 1 including forming two sets of two conductors, each set of conductors defining a current path.

3. The method of claim 2 including electrically coupling one end of each conductor in a set to a die on said substrate.

4. The method of claim 2 including electrically coupling one end of each conductor in a set to a voltage converter.

5. The method of claim 2 including aligning said conductors.

6. The method of claim 1 including forming said film of a plurality of laminations.

7. The method of claim 1 including forming said magnetic layers in a magnetic field to form the hard axes in said layers.

8. The method of claim 7 including alternating the hard axes of successive magnetic layers.

* * * * *